United States Patent [19]

Herbert

[11] Patent Number: 4,514,026

[45] Date of Patent: Apr. 30, 1985

[54] PLUG LOCKING DEVICE

[76] Inventor: Phil Herbert, 685 W. 1600 North, Mapleton, Utah 84663

[21] Appl. No.: 528,745

[22] Filed: Sep. 2, 1983

[51] Int. Cl.[3] ..... H01R 13/62

[52] U.S. Cl. ..... 339/75 P; 339/103 R

[58] Field of Search ..... 339/75 P, 103 R; 24/16 PB

[56] References Cited

U.S. PATENT DOCUMENTS

| | | | |
|---|---|---|---|
| 2,725,543 | 11/1955 | Tanner | 339/75 P |
| 3,475,716 | 10/1969 | Laig | 339/75 P |
| 4,440,465 | 4/1984 | Elliott et al. | 339/75 P |

*Primary Examiner*—John McQuade

[57] ABSTRACT

A plug locking device for preventing accidental separation of an extension cord plug from a primary plug wherein the extension plug is mated to the primary plug by means of an insertion prong or receptacle, the invention comprising an elongated strap which is attached to the extension cord plug by insertion of a first prong into a first opening at one end of the strap. This same end includes additional prongs which are used to attach the second end in wrapped configuration about the coupled plugs. This is accomplished by openings in the second end which are positioned on one or more of the prongs at the plug of the extension cord. An intermediate section of the strap is configured in geometry and length to permit it to be wrapped around the combined plugs, with the second end being returned to the site of the first end for attachment.

6 Claims, 4 Drawing Figures

PLUG LOCKING DEVICE

BACKGROUND OF THE INVENTION

1. Field of the Invention

This invention relates to devices for securing the male and female plugs of an electric cord together to avoid inadvertent separation when tension is applied to the cord. More specifically, the subject invention relates to a device for securing the female end of an extension cord to the plug of an electric cord, such as might be used for various items of movable electrical equipment.

2. Prior Art

It is not infrequent that a piece of electrical equipment, such as a drill, rotary saw, electrical garden clippers, etc., must be attached to an extension cord in order to operate at a desired location. In such circumstances, the attachment of the electrical device by its own cord to the extension cord is accomplished by merely inserting the male plug of the electrical device into the female plug of the extension cord. This arrangement is satisfactory as long as the electrical cord is not pulled free from the extension cord while the equipment is being moved from one location to another.

During such movement, it is a frustrating experience for the worker to be constantly on the move, only to pull the male plug free from the extension cord. The resulting need to reinstall the extension cord to the electrical device results in a waste of time, as well as the aggravation which normally accompanies the experience.

Several devices have been developed in an attempt to deal with the problem of cord separation. For example, U.S. Pat. No. 4,221,449 by Shugart, Jr. discloses a locking device comprising a longitudinal bar having a portion of its surface serrated, a fixed end member secured to one end of the bar and an adjustable moving locking member slidably mounted on the opposing end of the bar. The plug and socket to be secured are connected at the respective ends of the device to form a binding engagement which prevents the plugs from being separated. Although the device works in circumstances where the pulling force is applied along the longitudinal axis of the joined plugs, it fails to provide a sure locking engagement where the plug is pulled around a corner or along an arcuate path. In such circumstances, the plug is pulled free from the securing clips or members and is thereupon subject to separation.

A similar arrangement is shown in U.S. Pat. No. 4,145,105 by Dobson. This configuration comprises a first and second section, wherein the first section has a conically-shaped plug receptacle adapted to receive any of a plurality of different sized electrical plugs, and a detent slot for holding the cord affixed to the plug. The second section has a detent slot adapted to receive a second electrical cord. The two parts are joined by an adjustable means which connects the first and second sections. Although this configuration has some advantages over the earlier cited prior art, this latter device is somewhat cumbersome because it is comprised of two separate pieces. Not only are such pieces subject to being separated and lost, but the application of this device to a cord generally requires two hands in order to successfully secure the plugs together. Finally, its secured position is not totally immune from inadvertent separation, particularly where the cord is pulled around corners or the like.

U.S. Pat. No. 4,097,105 shows another device for harnessing connected plugs. The harness includes a primary ring-like member from which a pair of elongate connectors extend in perpendicular fashion. A second ring-like member is adjustably coupled to the elongate connectors to permit harness installation on a variety of plug/socket combinations. Although the harness provides a secure means of attachment, the configuration is cumbersome and awkward because of the numerous pieces involved, which may become separated and lost. Likewise, with a greater number of pieces to attach, both hands are needed to couple the harness to the connected plugs. Also, because of the numerous connecting joints, there is a greater tendency for the harness to break free under extreme twisting or extension.

Earlier prior art designs, considered to be less pertinent than those references cited above, include U.S. Pat. Nos. 3,475,716 by Laig; 2,461,427 by Kneebone; and 2,406,567 by Schueneman. The devices disclosed in these earlier patents conform to the structural types as disclosed above, and also carry the disadvantages previously referenced.

OBJECTS AND SUMMARY OF THE INVENTION

It is an object of the present invention to provide a locking device for connected plugs which have a unitary structure capable of being fastened in circumscribing manner around the plugs such that twisting motion does not affect inadvertent release by the locking device.

It is a further object of the present invention to provide a locking device which consists of a single strap to be conveniently wrapped around the mated plugs with a single hand.

Yet another object of the present invention is to provide a plug locking device which can be attached at one plug, wrapped around the connected pair of plugs, and then returned to the first plug to be firmly secured.

A still further object of the present invention is to provide a plug locking device which is integrally formed with the female end of an extension cord and is capable of being wrapped around the connected plug combination and returned to the integral point of attachment for securing.

These and other objects are realized in a retaining device for preventing accidental separation of an extension cord plug from a primary cord plug wherein the extension plug is mated to the primary plug by means of an insertion prong and receptacle which are carried in respective plugs. The device comprises a flat, elongated strap having a first end, a second end, and an intermediate section therebetween. The first end has first male and female fastening means spaced apart at a sufficient distance to enable a portion of the strap between the first male and the female fastening means to be wrapped around and fastened to the mated plugs. The first end further includes a second male fastening means which is positioned thereon such that it remains exposed when the first male and female fastening means are fixed around the plug. The second end includes a second female fastening means adapted for attachment to the second male fastening means of the first end. The intermediate section of the strap has sufficient length to enable its placement around the second plug in a manner wherein the respective plugs are secured together so that plugs cannot be pulled apart. The overall length of the device is sufficiently large to permit the first end to be secured at one plug, the intermediate section to be wrapped at least once around the mated plugs, and the second end to be returned and attached to the first end at the original plug. The present invention also comprehends the structure wherein the first end is formed as an integral part of the extension cord plug.

Other objects and features of the present invention will be apparent to those skilled in the art based upon the following detailed description, taken in conjunction with the following drawings, wherein.

DETAILED DESCRIPTION OF THE INVENTION

Figure 1:
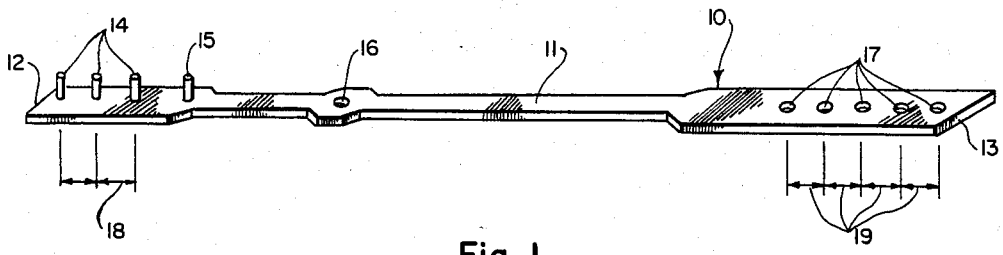
FIG. 1 shows a perspective view of one embodiment of the subject invention.

Referring now to the drawings:

A retaining device for locking plugs in their attached configuration is illustrated in open configuration in FIG. 1. The device comprises a flat, elongated strap 10 having a first end 12, a second end 13 and an intermediate section therebetween 11. In the embodiment of FIG. 1, the respective first and second ends include the section of strap having greater width, and extending down to the intermediate section 11 which has a narrower width. These widths are shown for the purpose of illustrating the respective parts of the strap and should not be construed as significant parts of the present structure. In reality, the full strap could be of single width and operate in an adequate manner.

Figure 2:
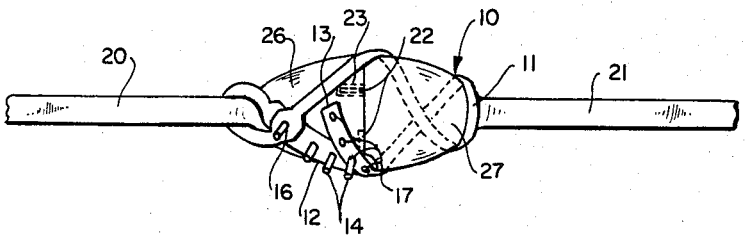
FIG. 2 shows the device of FIG. 1 wrapped about a pair of plugs which are thereby secured together.

The first end is further defined by first male and female fastening means, 15 and 16 respectively. The first male 15 and first female 16 fastening means are spaced apart at a sufficient distance to enable a portion of the strap therebetween to be wrapped around one of the mated plugs as shown in FIG. 2, and fastened together at opening 16. The purpose of the first male 15 and female 16 fastening means is to permit the attachment of the retaining device 10 around the cord 20 of one of the plugs 26 to be connected.

Normally, the first end will be attached around an extension cord plug 26 such that the extension cord can be used with numerous different electrical devices coupled via their electric cord 21 and plug 27. Once attached to the extension cord, the first male and female ends may be left in the attached position as a permanent part of the extension cord. The device 10 can then be wrapped around whatever plug is attached, and quickly removed for the next use. It will therefore be apparent to one skilled in the art that the distance between the respective fastening means 15 and 16 is determined by the size of the plug 26 and cord 20. The limit on size for the distance between fastening means 15 and 16 must therefore be greater than the circumference of cord 20 and less than the circumference of plug 26.

The configuration of the first male and female fastening means is illustrated in the figures to be a prong 15 and an opening 16 whose size is slightly larger than the diameter of the prong. This ensures a snug fit so that the first end of the strap 10 is retained at the plug location without inadvertent disconnection. If a tighter fit is required, a nub can be positioned at the upper end of prong 15 which requires the opening 16 to elongate in order to be secured over the prong. Typical fabrications with plastic materials inherently provide sufficient elongation characteristics to permit such attachment.

The first end further includes a second male fastening means 14 which is positioned thereon such that it remains exposed when the first male and female fastening means are fixed around the plug. Prongs 14 must remain exposed so that the second end 13 of the strap can be attached to the first end.

The second end 13 of the strap 10 includes second female fastening means 17 adapted for attachment to the second male fastening means 14 of the first end 12. Multiple points of attachment 17 are provided to enable the attachment of the strap 10 in tight configuraton, depending upon the size of the plugs being coupled and retained. The distances 19 between the respective openings 17 of the second female fastening means are equal to the distances 18 between the respective prongs 14 contained on the first end 12.

As illustrated in FIG. 2, one or more of the prongs 14 may be inserted into one or more of the corresponding openings 17, depending upon the plug sizes and position of the second end 13.

The intermediate section 11 extends from approximately point 16 to the beginning of openings 17. This intermediate section must have sufficient length to enable its placement around the second plug in a manner wherein the respective plugs are secured together. As illustrated in FIG. 2, this secure attachment may be accomplished by attaching the first end of strap 10 to plug 26 and cord 20 at point 16. The intermediate section 11 is then wrapped around the mated prongs 22 of the electrical cord in a FIG. 8 configuration as shown. The second end is attached to the first end via openings 17 which are secured to one or more of the prongs 14. In order to obtain such secure fixation, it will be apparent to one skilled in the art that the device must have sufficient overall length to permit the first end to be secured at one plug 26, the intermediate section 11 to be wrapped at least once around the mated plugs and the second end 13 to be returned to plug 26 and attached to the first end 12. In this configuration, the plugs are virtually inseparable because they are bound together by a continuous wrapping which specifically conforms to the shape of the plug. Therefore, during twisting and stretching motions, the plugs maintain their coupled configuration, with the stress being spread over various directions covered by the strap 10. Accordingly, the plug can be pulled around corners without catching or being broken loose, and can be thrown and pulled without fear of the plugs being pulled apart.

Figure 3:
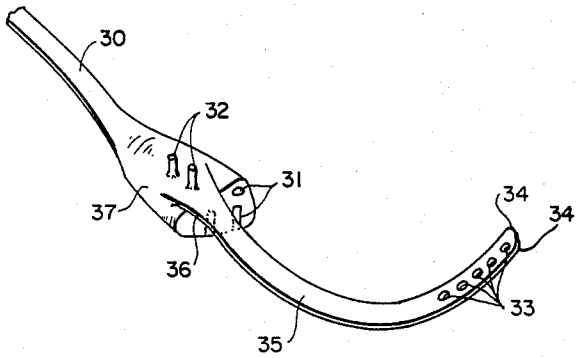
FIG. 3 illustrates another embodiment of the subject invention, wherein the device is formed integrally with the female plug of an extension cord.
Figure 4:
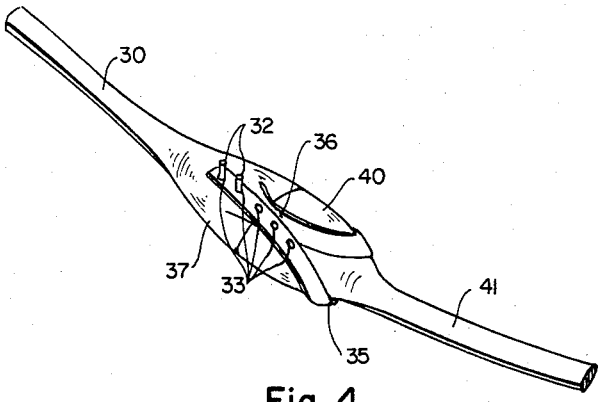
FIG. 4 shows the extension cord and device of FIG. 3, wrapped and attached to an electrical cord in accordance with the object and method of the present invention.

A second embodiment of the subject invention is illustrated in FIGS. 3 and 4. In this instance, the retaining device comprises a flat, elongated strap having a first end 36, a second end 34, and an intermediate section therebetween 35. The first end 36 is integrally formed or directly coupled to the extension cord 30 and plug 37. Typically, this will be injection molded as part of the plug structure.

The first end includes a male fastening means 32 which is positioned approximate to the extension cord plug 37 and is configured to project outwardly from the plug body. The combination of first end 36 with male fastening means 32 replaces the first male 15 and female 16 fastening means shown in FIGS. 1 and 2.

The second end 34 includes female fastening means 33 adapted for attachment to the male fastening means 32 of the first end. Here again, the spatial separation between openings 33 corresponds to the spatial separation between prongs 32. This enables adjustment of the strap to fit various sized plugs by using one or more of the prongs most convenient for attachment to the openings 33 when wrapped about a plug 40 and electrical cord 41 attached to some electrical device.

The intermediate section 35 again must have sufficient length to permit the elongated strap to be wrapped at least once around the mated plugs as shown in FIG. 4. Where the integral configuration of FIG. 3 is utilized, it is preferable to have the strap wrapped twice around the cord and plug so that it cannot slip free. For example, it would be apparent to one skilled in the art that the single wrapping shown in FIG. 4 could be pulled loose if sufficient force were applied to the plugs. If the strap were wrapped an additional time around cord 41, the plugs could not thereafter be separated until the fastening means were released.

It will be apparent to one skilled in the art that other configurations for the subject invention can be developed. For example, fastenings means other than the prong and opening combination may be applied. The significant feature which is to be realized by this and other configurations is that the strap is securely fastened to the extension cord plug and that the remaining intermediate and second end of the strap can then be maneuvered with a single hand to be wrapped around the plug combination and returned to the site of the first plug for secure attachment. It is to be understood that the scope and nature of the invention to be protected hereunder is to be found in the appended claims which follow.

I claim:

1. A retaining device for preventing accidental separation of an extension cord plug from a primary cord plug wherein the extension plug is mated to the primary plug by means of an insertion prong and receptacle which are carried in the respective plugs, said device comprising:

a flat, elongated, single, integrally formed strap having a first end, a second end and an intermediate section therebetween;

said first end having first male and female fastening means spaced apart at a sufficient distance to enable a portion of the strap between the first male and female fastening means to be wrapped around and fastened at one of the mated plugs;

said first end further including a second male fastening means which is positioned thereon such that it remains exposed when the first male and female fastening means are fixed around the plug;

said second end including a second female fastening means adapted for attachment to the second male fastening means of the first end;

said intermediate section having sufficient length to enable its placement around the second plug in a manner wherein the respective plugs are secured together so that plugs cannot be pulled apart;

said single strap having sufficient overall length to permit the first end to be secured at one plug, the intermediate section to be wrapped at least once around the mated plugs, and the second end to be returned and attached to the first end at the original plug.

2. A device as defined in claim 1 wherein the male fastening means comprises small prongs and the female fastening means comprises small openings adapted in size and configuration for the prongs to be removably inserted in the openings with a tight fit for secure retention.

3. A device as defined in claim 2 wherein the first end includes a single pair of male and female fastening means and said second male fastening means comprise at least two prongs spaced from each other at a predetermined distance, said second female fastening means including at least three openings spaced apart at the same predetermined distance to enable adjustable emplacement of the second end with respect to the first end, thereby adapting the device for attachment to cord plugs of differing sizes.

4. A retaining device for preventing accidental separation of an extension cord plug from a primary cord plug wherein the extension plug is mated to the primary plug by means of an insertion prong and receptacle which are carried in the respective plugs, said device comprising:

a flat, elongated, integrally formed strap having a first end, a second end and an intermediate section therebetween;

said first end being integrally formed with the extension cord plug and including a male fastening means which is positioned proximate to the extension cord plug and is configured to project outward from the plug body;

said second end including a female fastening means adapted for attachment to the male fastening means of the first end;

said intermediate section having sufficient length to permit the elongated strap to be wrapped at least once around the mated plugs, and the second end to be returned and attached to the first end at the extension plug.

5. A device as defined in claim 4, wherein the male fastening means comprise small nubs and the female fastening means comprise small openings adapted in size and configuration for the nubs to be removably inserted in the openings with a tight fit for secure retention.

6. A device as defined in claim 5 wherein the male fastening means of the first end comprises at least two nubs spaced from each other at a predetermined distance, said second female fastening means including at least three openings spaced apart at the same predetermined distance to enable adjustable emplacement of the second end with respect to the first end, thereby adapting the device for attachment to cord plugs of differing sizes.

* * * * *